US010384833B2

(12) United States Patent
Dean

(10) Patent No.: US 10,384,833 B2
(45) Date of Patent: Aug. 20, 2019

(54) VENT FOR ATTACHMENT TO THE HOLLOW HANDLE OF A JUG CONTAINER

(71) Applicant: Matthew F. Dean, Costa Mesa, CA (US)

(72) Inventor: Matthew F. Dean, Costa Mesa, CA (US)

( * ) Notice: Subject to any disclaimer, the term of this patent is extended or adjusted under 35 U.S.C. 154(b) by 26 days.

(21) Appl. No.: 14/989,616

(22) Filed: Jan. 6, 2016

(65) Prior Publication Data

US 2017/0190469 A1 Jul. 6, 2017

(51) Int. Cl.
*B65D 23/04* (2006.01)

(52) U.S. Cl.
CPC ..... *B65D 23/04* (2013.01); *B65D 2205/00* (2013.01)

(58) Field of Classification Search
CPC ..... B65D 1/02; B65D 23/04; B65D 2205/00
USPC ..... 137/137, 592; 215/902; 220/203.27, 220/203.28, 366.1, 580, 705, 714, 464.1, 220/468, DIG. 27, 913, 747, 745; 285/59; 222/478, 569, 468
See application file for complete search history.

(56) References Cited

U.S. PATENT DOCUMENTS

| | | | | |
|---|---|---|---|---|
| 575,954 | A | 1/1897 | Huffman | |
| 1,243,963 | A | 1/1917 | Moser | |
| 1,438,899 | A * | 12/1922 | Cassidy | A61J 1/05 215/11.6 |
| 3,066,819 | A | 7/1961 | Cox | |
| 3,198,367 | A | 8/1965 | Stickney | |
| 3,410,459 | A | 11/1968 | Conley | |
| 5,054,631 | A * | 10/1991 | Robbins, III | A47G 21/18 215/229 |
| 8,079,484 | B2 | 12/2011 | Wachsberg | |
| 2005/0040130 | A1 | 2/2005 | Bivens | |

* cited by examiner

*Primary Examiner* — Stephen J Castellano
(74) *Attorney, Agent, or Firm* — Aaron P. McGushion

(57) ABSTRACT

A vent for attachment to the hollow handle of a container is provided to prevent glugging and splashing of the fluid during pouring. The present vent enables the venting of air into the container as the fluid within the container is poured out. The present vent is angled to prevent attachment and flow of liquids on its outer surface during pouring, and to prevent outflow of liquids through the vent. The vent includes a venting conduit or other tube bent in at least one section and a hollow handle engager, such as an elastomeric stopper, to engage the inner passage of the hollow handle.

16 Claims, 3 Drawing Sheets

VENT FOR ATTACHMENT TO THE HOLLOW HANDLE OF A JUG CONTAINER

BACKGROUND

The present invention relates to a vent for a container, and more particularly, to an attachable vent for a jug container w with a hollow handle.

When pouring liquids from a jug container, such as a 1 gallon, ¾ gallon, or half-gallon plastic jug, a common problem arises when the flow of liquids exiting the mouth of the container prevent venting air from entering the container. This causes a glugging action, where in order for further liquid to exit the container, air must be allowed to enter the container through the mouth, temporarily interrupting the flow of the liquid and causing splashing and a lowered flow rate. The lowered flow rate causes interruption to user's work flow and inconvenience. The splashing can also be dangerous and damaging. For example, when pouring caustic liquids or the like, the glugging action of an improperly vented container can cause droplets of hazardous liquid to splash upon the user, causing burns, unhealthy exposure to the hazard, and damage to clothing, equipment, and the surrounding region.

Others have attempted to solve this problem by manufacturing internal vents integrally into the container. This is made difficult due to the limitations of common blow molding techniques. Thus, a safe, economical, and effective means to vent a container is needed.

SUMMARY

The present vent is attachable to the hollow handle of a container. In one embodiment, the vent comprises a venting conduit with a first opening, a second opening opposite the first opening and in fluid connection through the venting conduit with the first opening, and a bend in the venting conduit; and a hollow handle engager on the venting conduit situated in proximity with the first opening, where the hollow handle engager is configured to be fitted in engagement within the passage of the hollow handle when attached to the container, the bend positioning the second opening outside the mouth of the container to permit gases to enter the interior when pouring the liquid, the gases traveling into the second opening and out of the first opening and entering the interior through the passage of the hollow handle.

Optionally, the vent may further comprise a second bend formed on the venting conduit between the bend and the second opening. A second hollow handle engager may be situated in proximity with the first opening. The second hollow handle engager may be sized to be fitted in engagement within a second passage of a second hollow handle of a second container, where the second passage is sized differently than the passage of the container.

Again optionally, a first portion and a second portion of the venting conduit may be on opposing sides of the bend, where the second portion is angled relative to the first portion by the bend to extend from the mouth of the container and extend overtop the lip. The hollow handle engager may be shaped to fit in removable engagement within the passage of the hollow handle. The first portion and the second portion of the venting conduit may be directed substantially within the same plane, with the first portion and the second portion being directed in a transverse direction towards one another. The first portion and the second portion may be between 70° and 150° to one another.

LISTING OF REFERENCE NUMERALS of FIRST-PREFERRED EMBODIMENT

Figure 1:
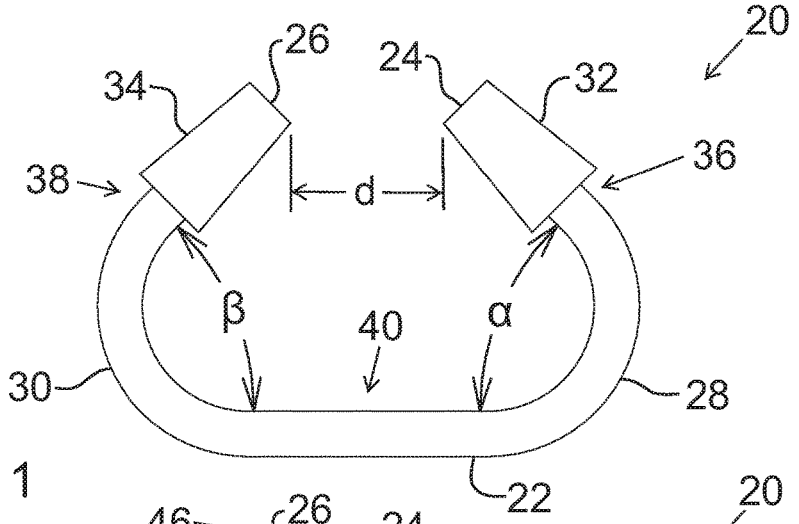
FIG. 1 is a side plan view of a first embodiment of the present container vent.

| | |
|---|---|
| vent | 20 |
| venting conduit | 22 |
| first opening | 24 |
| second opening | 26 |
| bend | 28 |
| second bend | 30 |
| hollow handle engager | 32 |
| second hollow handle engager | 34 |
| first portion | 36 |
| second portion | 38 |
| third portion | 40 |
| vent tube | 42 |
| swaged end | 44 |
| circumferential ribs | 46 |
| gap distance | d |
| bend angle | α |
| second bend angle | β |
| container | 200 |
| interior | 202 |
| enclosing sidewall | 204 |
| bottom wall | 206 |
| upper portion | 208 |
| lower portion | 210 |
| mouth | 212 |
| lip | 214 |
| hollow handle | 216 |
| passage | 218 |
| upper opening | 220 |
| lower opening | 222 |
| fluid | 300 |
| fluid stream | 302 |
| captured fluid | 304 |
| air | 400 |

DETAILED DESCRIPTION

The detailed descriptions set forth below in connection with the appended drawings are intended as a description of embodiments of the present vent, and is not intended to represent the only forms in which the present vent may be constructed and/or utilized. The descriptions set forth the structure and the sequence of steps for constructing and operating the present vent in connection with the illustrated embodiments. It is to be understood, however, that the same or equivalent structures and steps may be accomplished by different embodiments that are also intended to be encompassed within the spirit and scope of the invention.

The present container vent (20) provides an easy to use design that enables a user to pour liquids from a container (200), such as a standard plastic jug, without substantial glugging or gurgling which slows the pour and may cause splashing of dangerous chemicals. The present vent (20) can be quickly and ergonomically inserted and removed from a container (200) without delay or undue effort, so that the user will be more inclined to employ the vent (20) repeatedly over the course of multiple pours and using multiple containers. The present vent (20) is designed to permit air to enter the container (200) through the hollow handle (216) while permitting the smooth flow of fluid (300) from the mouth (212) of the container (200). The bent shape of the present vent (20) prevents undesirable flow of liquids on the surface of the vent which would result in a second stream or dribble of fluids separate from the main flow.

Several embodiments of the present container vent (20) are illustrated is FIGS. 1-6. Looking initially at FIG. 1, a first embodiment of the present vent (20) is shown primarily constructed of a vent conduit (22) with a hollow handle engager (32) on a first portion (36) of the vent conduit (22) and a second hollow handle engager (34) on a second portion of the vent conduit (22). The embodiment of FIG. 1 may be manufactured using a number of known techniques, including molding, using overmolding or other appropriate molding technique, or by bending standard tubing. In the presently illustrated example embodiment, the venting conduit (22) is made of standard 304 stainless steel tubing having a 0.25" outer diameter and a 0.194" inner diameter, or other substantially rigid material. The steel tubing may be bent using various known tube bending tools and techniques. Each of the bend angles are preferably about 150°, resulting in the first inner angle ($\alpha$) and the second inner angle (13), both being respectively supplementary angles to the 150° bend angles, thus are 30° in this example. The bend angles may from one another and each may vary from approximately 70° to 90° to 180° and greater; although other bend angles are possible, such as an angle of less than 90°, so long as the vent (20) does not permit a substantial amount of fluids to travel on the vent conduit (22) to create a separate stream or drips of fluid as the primary stream of fluid is being poured. In one embodiment, the first portion (36) and the second portion (38) may be angled approximately between 70° and 150° to one another, with a preferred angle of 120°. As will be discussed in greater detail below, the attachment to the hollow handle (216) of the container (200) may incline the vent (20) relative to the central axis of the mouth (212) of the container (200) so that the bend angle may need to be adjusted accordingly to provide venting without dripping or liquids entering the tube from the handle passage (218) and exit through the tube.

The first bend (28) and the second bend (30) may be formed such that the first portion (36) and the second portion (38) substantially lie within the same plane, within approximately a 0° to 20° angle to the plane. Alternatively, the first bend (28) and the second bend (30) may be formed such that first portion (36) and the second portion (38) are directed so that they are angled relative to one another, approximately at a 20° to 90° angle.

Frustoconical (tapered) laboratory stoppers with axial through holes may be fitted over one or both the first portion (36) and the second portion (38) of the venting conduit (22), at or near the first opening (24) or the second opening (26) to create the hollow handle engager (32) and the second hollow handle engager (34). However, the stoppers may extend beyond the first opening (24) and/or the second opening (26) or may be fitted well short of the first opening (24) and/or the second opening (26). The laboratory stoppers may be made of a natural rubber, a synthetic rubber, such as nitrile or VITON, a cork material, a silicone rubber material or other appropriate material depending on the chemical in the container and the demands for purity. It is preferable that both the venting conduit (22) and the hollow handle engagers (32 and 34) be made of an inert and chemically resistant material to prevent contamination of the fluid and to prevent undue chemical deterioration, by withstanding many solvents, acids, and salts. Example trade sizes of the laboratory stoppers may include 00 or 000. For example, the 00 size stopper may be attached to the first portion (36) and the 000 may be attached to the second portion (38) so that the vent (20) may accommodate containers (200) with differing sized passages (218) within the respective hollow handles (216) such that the vent (20) fits most standard industry containers. A swaged end (44) or other enlargement or flaring may be created to prevent the stopper from sliding off the venting conduit (22).

The in the example configuration shown in FIG. 1, the venting conduit (22) is made of a length of stainless steel tubing with a first bend (28) and a second bend (30), although various materials of various cross-sectional shapes may be used. A first portion (36) of the venting conduit (22) is formed between the first bend (28) and the first opening (24), and may include all or part of the first bend (28). A second portion (38) of the venting conduit (22) is formed between the second bend (30) and the second opening (26), and may include all or part of the second bend (30). A third portion (40) of the venting conduit (22) is formed between the first bend (28) and the second bend (30), and may include all or part of either or both the first bend (28) and the second bend (30). Although the first, second, and third portions (36, 38, and 40) are shown as being straight lengths, these portions may also be bent or curved, as part of the first and second bends (28, 30) or a bend of a differing bending radius.

Figure 5:
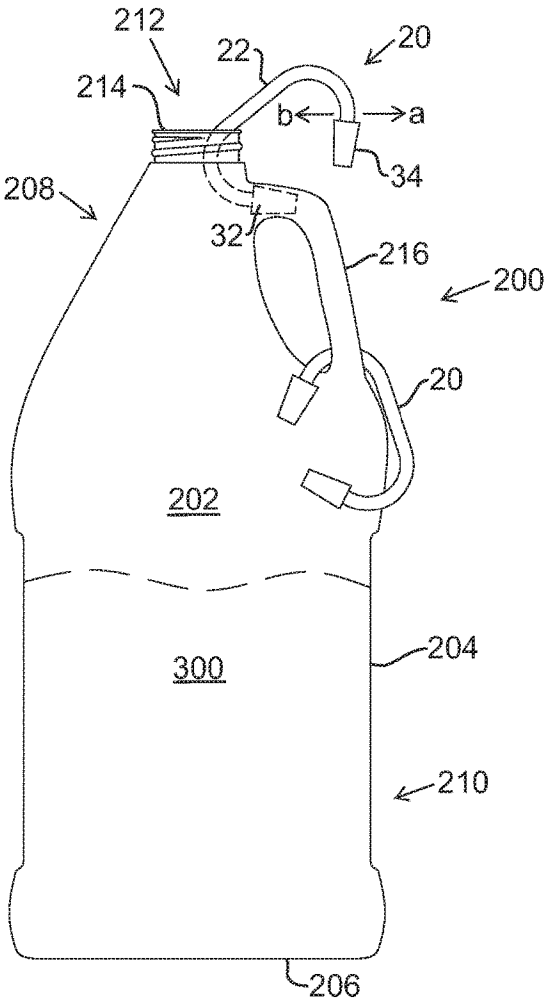
FIG. 5 is a side plan view of the present vent attached within the hollow handle of a typical container.

It is a preference that the gap distance (d) between the hollow handle engager (32) and the second hollow handle engager (34) be just wide enough to permit the vent (20) to be hooked onto the handle (216) of the container (200). Since certain embodiments of the hollow handle engager (32) and the second hollow handle engager (34) are rubber stoppers, the gap distance (d) may be slightly smaller than the handle width so that the rubber stoppers flex slightly as they are pushed past the handle (216). This slight interference prevents the vent (20) from inadvertently falling off the handle (216), yet permits the user to quickly attach and detach the vent (20) to the container (200), as shown in FIG. 5. If the venting conduit (22) is slightly flexible, the same result may be achieved by permitting the venting conduit (22) to flex as the vent (20) is attached or removed from the handle (216).

Figure 2:
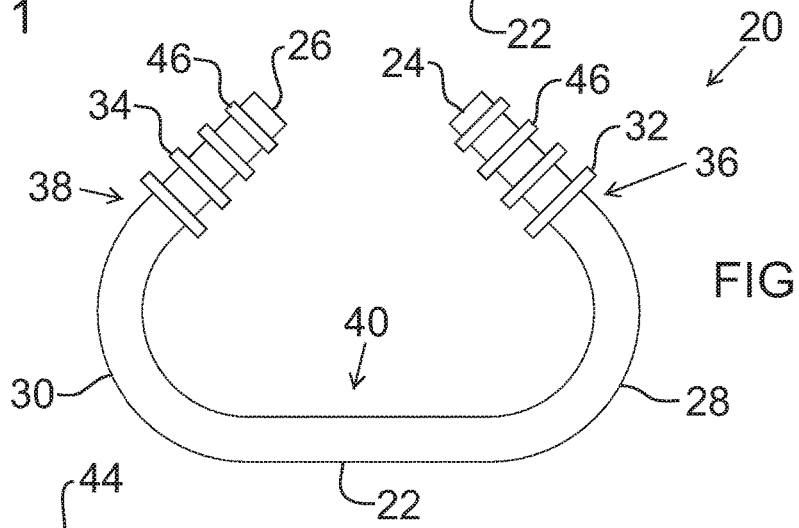
FIG. 2 is a side plan view of a second embodiment of the present container vent.
Figure 3:
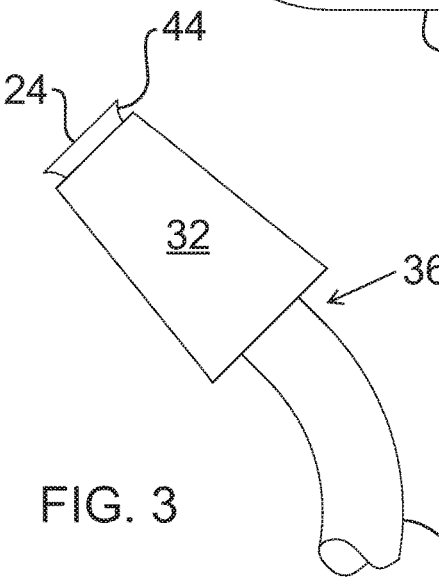
FIG. 3 is a magnified view of the first portion of the vent of FIGS. 1 and 4, showing a swaged tube end.

A variation of the embodiment of FIG. 1 can be seen in FIG. 2, where the vent (20) may be molded as a single unit. For example, using an overmold process, the hollow handle engager (32) and the second hollow handle engager (34) may be molded over the venting conduit (22), where the hollow handle engager (32) and the second hollow handle engager (34) are made from an elastomeric or pliable material. A series of circumferential ribs (46) are molded or attached to one or both of the first portion (36) and the second portion (38) to create the hollow handle engager (32) and the second hollow handle engager (34). The circumferential ribs (46) may vary in diameter to converge towards the first opening (24) and the second opening (26). The venting conduit (22) may be made of a plastic, metal, or other appropriate material.

Figure 4:
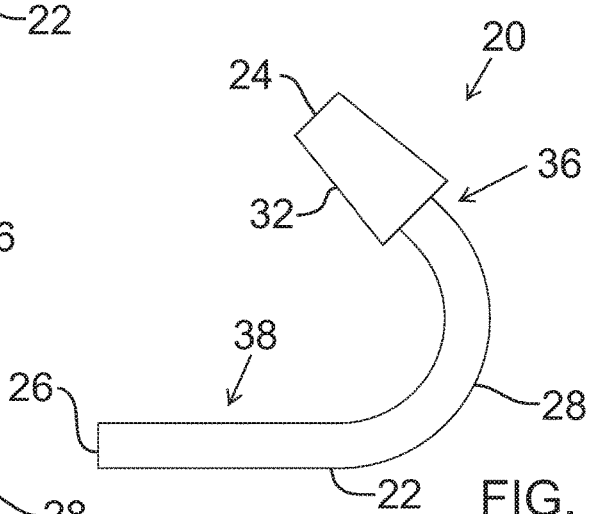
FIG. 4 is a side plan view of a third embodiment of the present container vent.

Yet another variation of the present vent (20) can be seen illustrated in FIG. 4, showing a single bend. In this embodiment, the hollow handle engager (32) would be configured to fit within a single type of hollow handle (216), when using a less pliable material to make the hollow handle engager (32). Alternatively, the material selected to make the hollow handle engager (32) may be sufficiently pliable or elastic to permit the hollow handle engager (32) to be made oversized, so that it is substantially compressed when inserted into a small passage (218) and less compressed when inserted into a larger passage (218).

Figure 6:
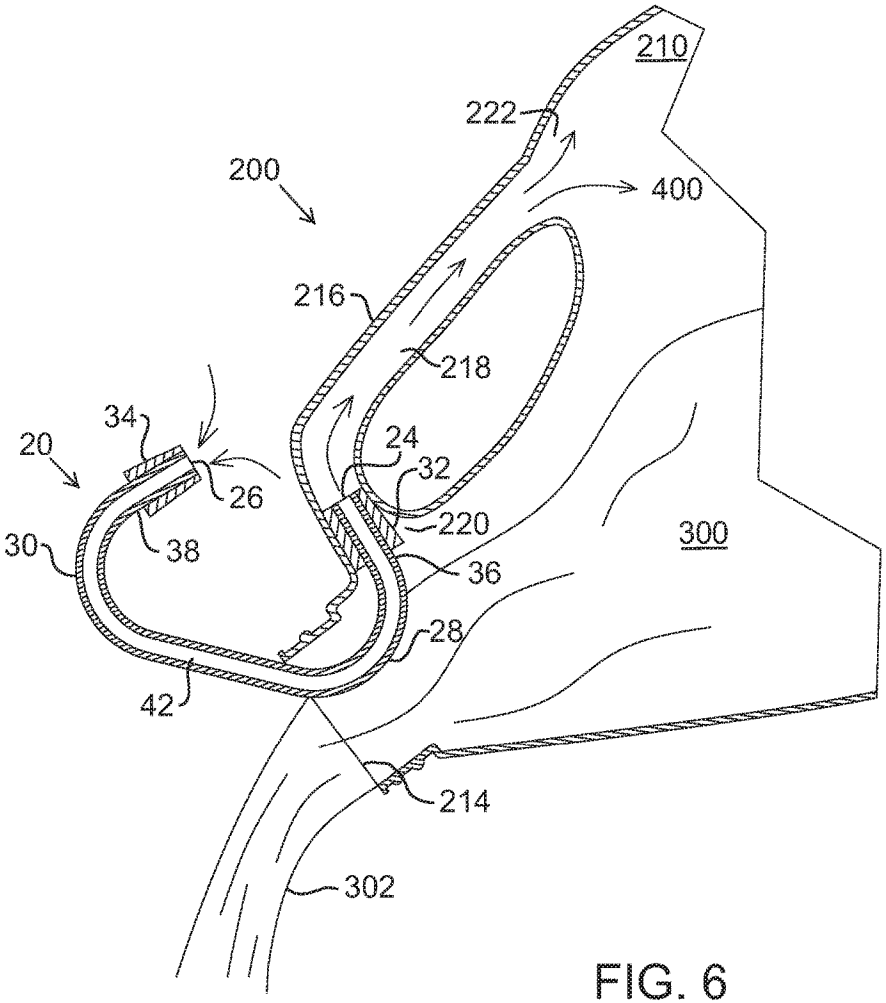
FIG. 6 is a partial sectional view taken through the center of the mouth and handle of the container, showing liquid being poured from the container while air is introduced into the container through the vent.

Looking now at FIGS. 5 and 6, the present vent (20) is shown attached within the container (200), with the hollow handle engager (32) frictionally engaged within the passage (218), although the hollow handle engager (32) may be also adhered into the passage (218). The container (200) has an enclosing sidewall (204) and a bottom wall (206) that define an interior (202), which contains a fluid (300). The container (200) further has a mouth (212) defined by a lip (214). The container (200) also has a upper portion (208), nearer the upper opening (220) of the passage (218), and a lower portion (210), nearer the lower opening (222) of the passage (218).

It can be seen that the first bend (28) and the second bend (30) created an open-cornered triangle that provides an ergonomically correct design to permit easy insertion and withdrawal of the vent (20) from the container (200). In the illustrated configuration, to attach the vent (20) to a container (200), a user may grasp the second portion (38) and second hollow handle engager (34) with the index finger and/or the middle and the thumb, engaging the hollow handle engager (32) into the passage (218) by pulling in the direction of arrow (a). Oppositely, the user may withdraw the vent (20) by grasping the handle (216) with the fingers, and pushing on second hollow handle engager (34) with the thumb in the direction of arrow (b). The present design provides a comfortable, intuitive, and quick means to attach and remove the vent (20) from the container (200).

Looking more closely at FIG. 6, the container (200) is shown in a tipped configuration, where the fluid (300) pours from the mouth (212) of the container (200) in a smooth fluid stream (302). The fluid stream (302) is permitted to flow around the venting conduit (22) without substantial interference. The bend angle of the bend (28) sufficiently angles the third portion (40) relative to the first portion (36) and/or the rim (214) of the container (200) to substantially prevent the fluid (300) from attaching to and flowing along the venting conduit (22) to create an undesirable second stream or drips. In this example, the third portion (40) extends from the mouth (212) and over the rim (214). Also, the second portion (38) and second opening (26) are located completely outside the container (200). If the embodiment of FIG. 4 were to be similarly attached to the container (200), the second portion (38) would extend from the mouth (212) and over the rim (214).

As the fluid (300) is poured from the container, the present vent (20) permits air or other surrounding gas to enter the lower portion (210) of the container (200) through the passage (218). The air (400 enters the second opening (26), passes through the vent tube (42), out of the first opening (24), into the upper opening (220), through the passage (218), out of the lower opening (222), and into the lower portion (210) of the container (200). In this way, air is introduced at a rate sufficient to reduce or eliminate the vacuum created in the lower portion (210) by the exiting liquid (300).

Figure 8:
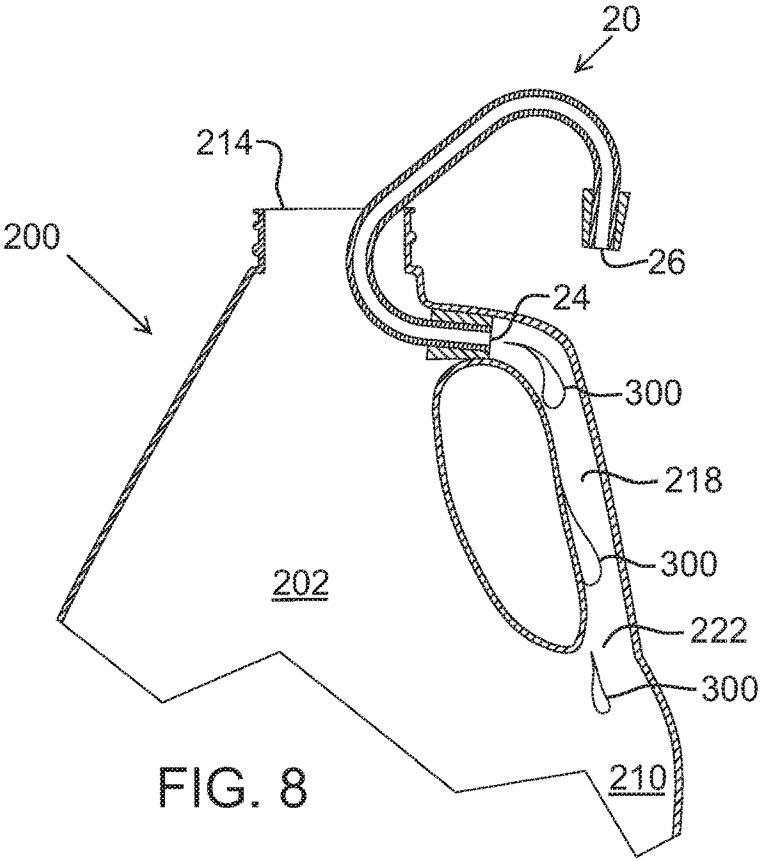
FIG. 8 is a partial sectional view taken through the center of the mouth and handle of the container, showing the liquid dripping back into the container after being uprighted.
Figure 7:
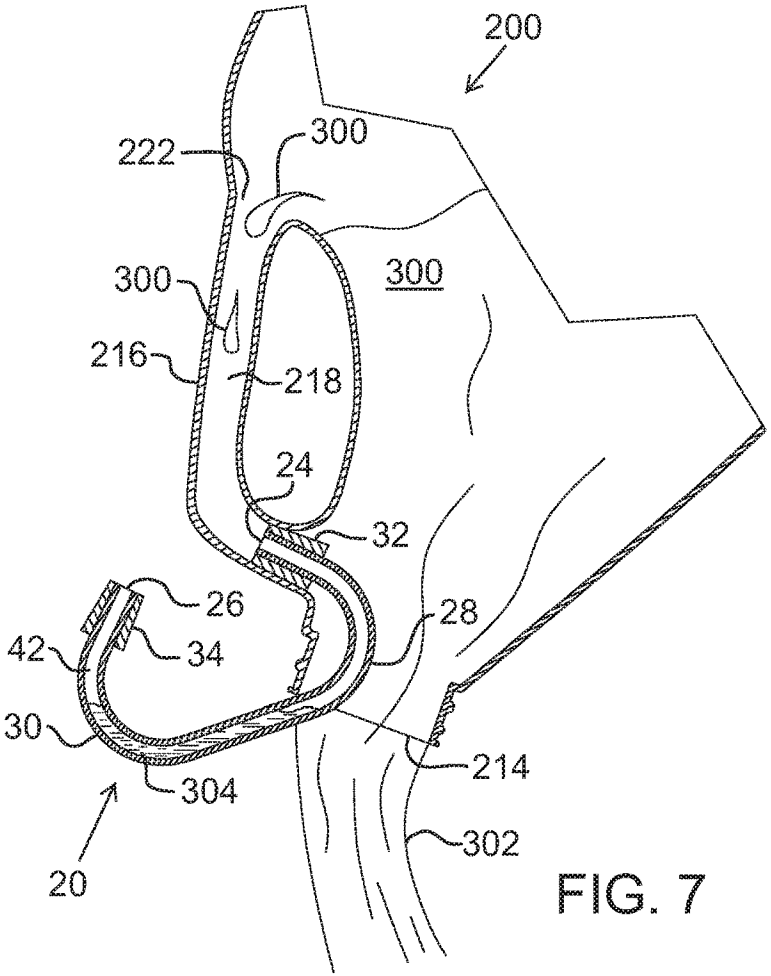
FIG. 7 is a partial sectional view taken through the center of the mouth and handle of the container, showing liquid being trapped within the vent to prevent a secondary stream or drip of liquid.

FIG. 7 illustrates a condition where a small amount of fluid (300) flows into the lower opening (222) of the hollow handle (216) and into the vent (20). The bend (28) is configured to substantially prevent this liquid from exiting the second opening (26) of the vent (20) by creating a trap in which trapped fluid (304) is prevented from flowing out of the second opening (26). The bend (28) and the second bend (30) additionally may work together to further trap fluid throughout the vent tube (42). As the container (200) is tilted back to an upright orientation, the trapped fluid (304) flows back into the container (200) through the passage (218) of the hollow handle (216), as shown in FIG. 8.

While particular forms of the present vent (20) have been illustrated and described, it will also be apparent to those skilled in the art that various modifications can be made without departing from the spirit and scope of the invention. For example, the first, second and third portions may be straight or curved into a bend; the venting conduit (22) may be C-shaped or other shape that permits the inflow of air, yet prevents fluid (300) from flowing on the outer surface of the venting conduit (22) and substantially prevents the outflow of fluid (300) through the venting conduit (22); and the venting conduit (22) may have a square, triangular, or other cross-sectional shape. Accordingly, it is not intended that the invention be limited except by the claims.

What is claimed is:

1. A vent for attachment to a fluid container with a hollow handle, the vent comprising:

a venting conduit comprising a first bend, a first opening at a first end, and a second opening at a second end, and a second bend formed between the first bend and the second opening a first portion of the venting conduit defined between the first opening and the first bend, a second portion defined between the second opening and the second bend and being angled relative to the first portion, and a third portion of the venting conduit defined between the first bend and the second bend, the first portion and the second portion being directed in a direction towards and transverse to one another such that the first opening of the first portion and the second opening of the second portion converge toward one another; and a hollow handle engager situated on the first portion of the venting conduit.

2. The vent of claim 1 further comprising a second hollow handle engager situated on the second portion of the venting conduit, wherein the first portion and the second portion of the venting conduit are substantially within the same plane.

3. The vent of claim 2 wherein the first portion and the second portion are substantially perpendicular to one another.

4. The vent of claim 1 wherein the first portion, the second portion, and the third portion of the venting conduit are substantially straight.

5. The vent of claim 1 wherein the hollow handle engager is made of a deformable material.

6. The vent of claim 1 wherein the hollow handle engager surrounds the venting conduit, the hollow handle engager tapered to converge towards the first end to form a conical frustum.

7. The vent of claim 1 further comprising a second hollow handle engager situated on the second portion of the venting conduit.

8. The vent of claim 1 wherein the hollow handle engager comprises a tapered stopper with an axial through hole, the first portion inserted through the axial through hole.

9. The vent of claim 8 further comprising a second tapered stopper with a second axial through hole, the second portion inserted through the second axial through hole.

10. A vent for attachment to a container, the container having an interior defined by an enclosing sidewall and a bottom wall for storing a fluid therein, the interior having an upper portion and a lower portion, a mouth defined by a lip, and a hollow handle extending from the sidewall and fluidly connecting the upper portion to the lower portion through a passage, the vent comprising:

a venting conduit having a first opening, a second opening opposite the first opening and in fluid connection through the venting conduit with the first opening, and a bend in the venting conduit, and a second bend formed between the bend and the second opening, a first portion of the venting conduit defined between the first opening and the bend, a second portion of the venting conduit defined between the second opening and the second bend, and a third portion of the venting conduit defined between the bend and the second bend, the first portion and the second portion being directed in a direction towards and transverse to one another such that the first opening of the first portion and the second opening of the second portion converge toward one another; and a hollow handle engager on the venting conduit situated in proximity with the first opening, the hollow handle engager being configured to be inserted through the mouth of the container and thereafter configured to be fitted in engagement within the passage of the hollow handle when being attached to the container, the bend positioning the second opening outside the mouth of the container to permit gases to enter the interior when pouring the liquid, the gases traveling into the second opening and out of the first opening and entering the interior through the passage of the hollow handle, and permitting the fluid to freely flow from the mouth.

11. The vent of claim 10 further comprising a second hollow handle engager situated in proximity with the first opening.

12. The vent of claim 11 wherein the second hollow handle engager being sized differently than the hollow handle engager, the second hollow handle engager is sized to be fitted in engagement within a second passage of a second hollow handle of a second container, the second passage being sized differently than the passage of the container.

13. The vent of claim 10 wherein the hollow handle engager being shaped to fit in removable engagement within the passage of the hollow handle.

14. The vent of claim 10 wherein the first portion and the second portion of the venting conduit are substantially within the same plane.

15. The vent of claim 14 wherein the first portion and the second portion are angled between 70° and 150° to one another.

16. The vent of claim 10 further comprising a second hollow handle engager situated in proximity with the first opening, the second hollow handle engager is sized to be fitted in engagement within a second passage of a second hollow handle of a second container, the second passage being sized differently than the passage of the container.

* * * * *